US006281845B1

(12) United States Patent
Ittipiboon et al.

(10) Patent No.: US 6,281,845 B1
(45) Date of Patent: Aug. 28, 2001

(54) DIELECTRIC LOADED MICROSTRIP PATCH ANTENNA

(75) Inventors: Apisak Ittipiboon, Kanata; Aldo Petosa, Nepean; Michel Cuhaci, Ottawa, all of (CA)

(73) Assignee: Her Majesty the Queen in right of Canada, as represented by the Minister of Industry, Ottawa (CA)

( * ) Notice: Subject to any disclaimer, the term of this patent is extended or adjusted under 35 U.S.C. 154(b) by 0 days.

(21) Appl. No.: 09/455,336

(22) Filed: Dec. 6, 1999

(30) Foreign Application Priority Data

Jan. 12, 1999 (CA) ..... 2257526

(51) Int. Cl.[7] ..... H01Q 1/38
(52) U.S. Cl. ..... 343/700 MS; 343/846; 343/848
(58) Field of Search ..... 343/700 MS, 846, 343/848, 829, 830

(56) References Cited

U.S. PATENT DOCUMENTS

| | | | | |
|---|---|---|---|---|
| 4,843,400 | * | 6/1989 | Tsao et al. | 343/700 MS |
| 4,958,162 | * | 9/1990 | Roberts et al. | 343/700 MS |
| 5,355,143 | * | 10/1994 | Zurcher et al. | 343/700 MS |
| 5,444,453 | | 8/1995 | Lalezari | 343/700 MS |
| 5,448,252 | | 9/1995 | Ali et al. | 343/700 MS |
| 5,734,350 | | 3/1998 | Deming et al. | 343/700 MS |

OTHER PUBLICATIONS

"High Performance Miniaturized Microstrip Antennas on Locally Non–Homogenous Substrates" Lattard et al. 29$^{th}$ European Microwave Conference, Munich 1999 pages.

* cited by examiner

*Primary Examiner*—Tan Ho
(74) *Attorney, Agent, or Firm*—Freedman & Associates

(57) ABSTRACT

A dielectric loaded microstrip patch antenna is provided for delivering relatively wide operational bandwidth dual-band, with relatively good isolation and flexibility for circular polarization, while having a compact design and lightweight to suit mobile and wireless applications. The microstrip patch antenna has a conducting ground plane and a patch radiator. The patch radiator is spaced from the ground plane by a substantial distance having a first dielectric material therein. A slot feed in the ground plane provides the patch radiator with radio signal energy across the space having the first dielectric material therein. A piece of a second dielectric material is disposed adjacent the slot feed between the patch radiator and the ground plane. The second dielectric material has a dielectric constant that is higher than the dielectric constant of the first dielectric material. The piece of the second dielectric material acts to load the feed in order to improve coupling between the slot and the patch. The piece has a dimension along one of the x and y axes smaller than a dimension of the patch along a same axis. Since the piece is situated between the ground plane and the patch it determines operational characteristics of the microstrip patch antenna.

16 Claims, 10 Drawing Sheets

DIELECTRIC LOADED MICROSTRIP PATCH ANTENNA

FIELD OF THE INVENTION

The invention relates to microstrip patch antennas and more particularly to a microstrip patch antenna spaced from a ground plane by a substance having a very low dielectric constant such as air.

BACKGROUND OF THE INVENTION

The performance of an antenna is determined by several parameters, one of which is efficiency. For a microstrip antenna, "efficiency" is defined as the power radiated divided by the power received by the input to the antenna. A one-hundred percent efficient antenna has zero power loss between the received power input and the radiated power output. In the design and construction of microstrip antennas it is desirable to produce antennas having a relatively high efficiency rating, preferably in the range of 95 to 99 percent.

One factor in constructing a high efficiency microstrip antenna is minimizing power loss, which may be caused by several factors including dielectric loss. Dielectric loss is due to the imperfect behavior of bound charges, and exists whenever a dielectric material is located in a time varying electrical field. Moreover, because dielectric loss increases with operating frequency, the problem of dielectric loss is aggravated when operating at higher frequencies.

The extent of dielectric loss for a particular microstrip antenna is determined by, inter alia, the permittivity, $\in$, expressed in units of farads/meter (F/m), of the dielectric space between the radiator and the ground plane which varies somewhat with the operating frequency of the antenna system. As a more convenient alternative to permittivity, the relative dielectric constant, $\in_r$, of the dielectric space may be used. The relative dielectric constant is defined by the equation:

$$\in_r = \in / \in_o$$

where $\in$is the permittivity of the dielectric space and $\in_o$ is the permittivity of free space (8.854.times.10.sup.−12 F/m). It is apparent from this equation that free space, or air for most purposes, has a relative dielectric constant approximately equal to unity.

A dielectric material having a relative dielectric constant close to one is considered a "good" dielectric material—that is, the dielectric material exhibits low dielectric loss at the operating frequency of interest. When a dielectric material having a relative dielectric constant equal to unity is used, dielectric loss is effectively eliminated. Therefore, one method for maintaining high efficiency in a microstrip antenna system involves the use of a material having a low relative dielectric constant in the dielectric space between the radiator patch and the ground plane.

Furthermore, the use of a material with a lower relative dielectric constant permits the use of wider transmission lines that, in turn, reduce conductor losses and further improve the efficiency of the microstrip antenna.

The use of a material with a low dielectric constant, however, is not without drawbacks. One typical drawback is that it is difficult to produce high-speed compact patch antennas spaced from a ground plane by a "good" dielectric. When a dielectric material disposed between a patch and a ground plane has a low dielectric constant (about 1), the resulting patch size is large (for example at 3.6 GHz patches of about 1550 $mm^2$ result). For mobile applications and for use in arrays, such a patch size is often problematic.

Another problem with antennas as described above is that the feed efficiency often degrades substantially as the patch is spaced further away from the ground plane. That said, more spacing of the patch from the ground plane is often advantageous and, as such, is usually accommodated using dielectric material with a higher dielectric constant to fill the space between the patch and the ground plane. Unfortunately, efficiency is substantially compromised in order to meet other design parameters.

It would be advantageous to provide a patch antenna that is spaced a distance from a ground plane and efficiently coupled to a feed absent a substrate having a high dielectric constant filling the space therebetween.

SUMMARY OF THE INVENTION

In accordance with the invention there is provided a patch antenna comprising a ground plane, a feed and a patch spaced from the ground plane by a predetermined distance. A dielectric material having a low dielectric constant is disposed therebetween. This dielectric material could be air, foam, or the like. In order to improve coupling efficiency between the patch and the feed, a piece of second dielectric material having a higher dielectric constant than the dielectric material is inserted between the patch and the ground plane in order to load the feed and thereby improve coupling efficiency between the feed and the patch. Exact placement of the piece of the second dielectric material is important for optimising antenna performance.

Further pieces of another dielectric material are optionally disposed between the ground plane and the patch to shape the radiation fed to the patch. This permits a smaller size patch than would be possible in a conventional air spaced patch antenna.

In accordance with the invention there is provided a microstrip patch antenna comprising:

- a patch radiator;
- a conducting ground plane spaced from the patch radiator by a first predetermined distance along a z-axis;
- a first dielectric material having a low dielectric constant and disposed between the ground plane and the patch radiator;
- a feed for providing the patch radiator with radio signal energy; and,
- a second dielectric material having a relative dielectric constant greater than that of the first dielectric material for loading the feed and having a dimension along an axis orthogonal to the z-axis smaller than a dimension along a same axis of the patch and disposed between said patch radiator and said ground plane for determining operational characteristics of said microstrip patch antenna.

In accordance with another embodiment of the invention there is provided a microstrip patch antenna comprising:

- a conducting ground plane having a thickness along a z axis and dimensions along an x and y axis orthogonal to the z axis;
- a patch radiator spaced by a first dielectric material having a low dielectric constant from the ground plane along the z-axis orthogonal;
- a slot feed for providing the patch radiator with radio signal energy across the space containing the first dielectric material; and,
- a piece of second dielectric material adjacent the slot feed between the patch radiator and the ground plane for loading the feed and having a dimension along one of the x and y axes smaller than a dimension of the patch along a same axis, wherein the piece of second dielectric material determines operational characteristics of the microstrip patch antenna, the second dielectric material having a dielectric constant that is higher than the dielectric constant of the first dielectric material.

In accordance with another aspect of the present invention there is provided a method of designing a microstrip patch antenna comprising the steps of:

providing a design of a patch radiator;

providing a design of a conducting ground plane spaced from the patch radiator by a first predetermined distance along a z-axis;

providing a design for a feed for providing the patch radiator with radio signal energy; and, providing a design for a second dielectric for loading the feed and having a dimension along an axis orthogonal to the z-axis smaller than a dimension along a same axis of the patch and disposed between said patch radiator and said ground plane for determining operational characteristics of said microstrip patch antenna simulating the provided designs; and, adjusting the design of the second dielectric until a desired radiation pattern from the microstrip patch results.

Advantageously, an antenna according to the invention provides high speed, high efficiency, and reasonable bandwidth with reduced size over prior art air gap patch antennas.

BRIEF DESCRIPTION OF THE DRAWINGS

The invention will now be described in conjunction with the following drawings.

DETAILED DESCRIPTION OF THE INVENTION

Figure 1:
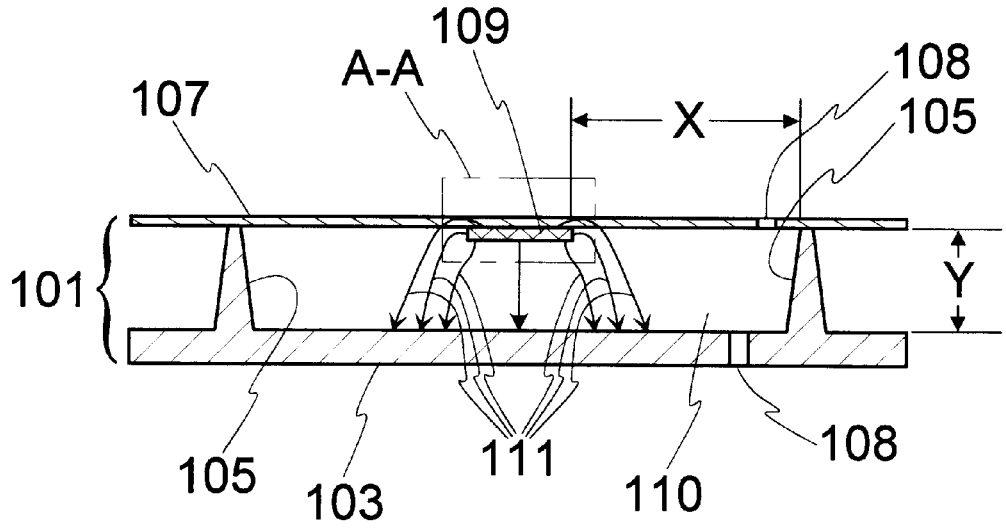
Fig. 1 (Prior Art)
FIG. 1 is a side view of the inverted microstrip antenna structure according to the prior art.

Referring to FIG. 1, a prior art air spaced patch radiator is shown. An inverted microstrip antenna structure is indicated generally at 101. In its simplest form, a microstrip antenna comprises a radiator patch that is separated from a ground plane by a dielectric space.

In the prior art shown, the inverted microstrip antenna 101 comprises a radiator layer 106 that includes a thin substrate layer 107 made of a dielectric material having suitable dielectric and rigidity properties. Affixed to a bottom face of the substrate layer 107 is a radiator patch 109, made of electrically conductive material. The radiator patch 109 is made by appropriate etching of the thin substrate layer 107 having one or both faces entirely coated with the conductive material. Alternatively, the radiator patch is affixed by one of several available means; for example, an elastic adhesive or glue is applied to the surface area formed by the contact of the substrate layer 107 and the radiator patch 109 to hold the radiator patch 109 securely in place.

As an alternative to etching and affixing, the radiator patch 109 may be formed directly on the substrate layer 107 using one of several different methods including mirror metallizing techniques, decal transfer techniques, silk screening, or other printed circuit techniques.

Supporting the radiator layer 106 is a ground plane 103 made of electrically conductive material having a plurality of integral support posts or dimples 105 extending substantially perpendicularly from one face of the ground plane 103.

The sides of the inverted microstrip antenna 101 are not covered and, as a consequence, leave the space between the ground plane 103 and the radiator layer 106 exposed to the external environment. This can serve, at least in terrestrial applications, to reduce side wind loading and promote the drainage or evaporation of moisture located in the space. Similarly, one or more holes 108 can be established in the ground plane 103 and/or radiator layer 106 to reduce frontal and back wind loading on the antenna 101 or promote evaporation or drainage of moisture. Any holes 108 established in the ground plane 103 should be located and of a dimension that avoids producing a resonant structure with the radiator patch 109 that substantially reduces the efficiency of the antenna 101.

The prior art antenna design is excellent when a patch is very closely spaced from the ground plane. Unfortunately, as frequency of operation increases, optimal spacing between the ground plane and the radiator increases. This results in coupling inefficiencies and trade-offs are made in antenna design to balance these trade-offs.

According to the present invention, an antenna design is presented that provides for a patch spaced from the ground plane for improved high frequency operation and having more efficient coupling with a feed than the previously described antenna with similar spacing. This is achieved by loading the patch antenna using a piece of dielectric material in order to improve coupling between a feed and the patch.

Figure 2:
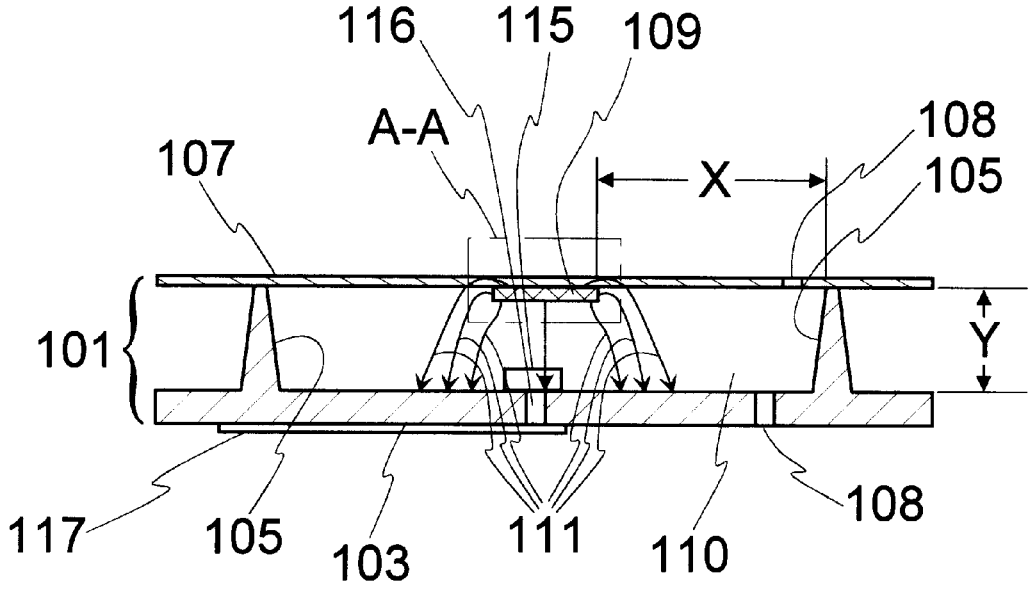
Fig. 2 (Prior Art)
FIG. 2 is a side view of the inverted microstrip antenna structure similar to the antenna structure of FIG. 1 with a piece of dielectric material for loading the patch according to the invention.

Referring to FIG. 2, a simple embodiment of the invention is presented. The embodiment has similar elements to the prior art antenna of FIG. 1 with the addition of a piece of dielectric material 115 having a higher dielectric constant than the dielectric material in the gap between the patch and the ground plane. The piece is shown in the form of a block. The dielectric block 115 is shown adjacent a feed 116 in the form of a slot fed by a microstripline 117. The slot feed 116 is loaded by the dielectric block 115 which effects the field radiated from the slot. Careful selection of the dielectric block material, size, shape, and location results in an improved coupling between the slot 116 and the patch 109 even with substantial distances therebetween. By properly loading a patch, its operational characteristics including resonating frequency and its quality factor which is related to operational bandwidth are modified. This provides substantial control over coupling efficiency in a controlled geometric environment.

Referring to FIGS. 3*a*, 3*b*, 3*c*, and 3*d*, an embodiment of the present invention is shown including further pieces of second dielectric material 113 for effecting the Q factor further to shape radiation fed to the patch 109 in order to meet design criteria with a smaller radiating patch.

Loading of the patch is achieved using dielectric means in the form of dielectric strips 115 and 113, which are strategically placed between the microstrip patch radiator 109 and the ground plane 103. The antenna geometry shown comprises a conducting microstrip patch 109 suspended in air above a ground plane 103 at least one peripheral dielectric strip 113 having a dielectric constant $\in_{r1}$ and a central dielectric strip 115 having a dielectric constant $\in_{r2}$ and feeding means in the form of a feed network having a microstrip feed line 117 and a feed slot 116. Though the term suspended in air is used above, the patch 109 is typically supported by a thin dielectric substrate. This allows for accurate patch spacing and size without substantially affecting efficiency of the antenna. The operating frequency of the antenna is determined by the dielectric permittivity, dimensions, and location of the peripheral dielectric strips 113. The maximum effect will occur at the location where the electric field is maximum. The central dielectric strip 115 is used to perform the function of matching the impedance of the antenna to that of the feed network. In FIGS. 3*a*, 3*b*, 3*c*, and 3*d*, the feed network is represented by a feed slot 116 in the ground plane 103, however, this approach is equally valid for other forms of feeding means to provide radio signal energy to the patch radiator 109, including a probe and proximity coupled microstrip lines (not shown).

Figure 4:
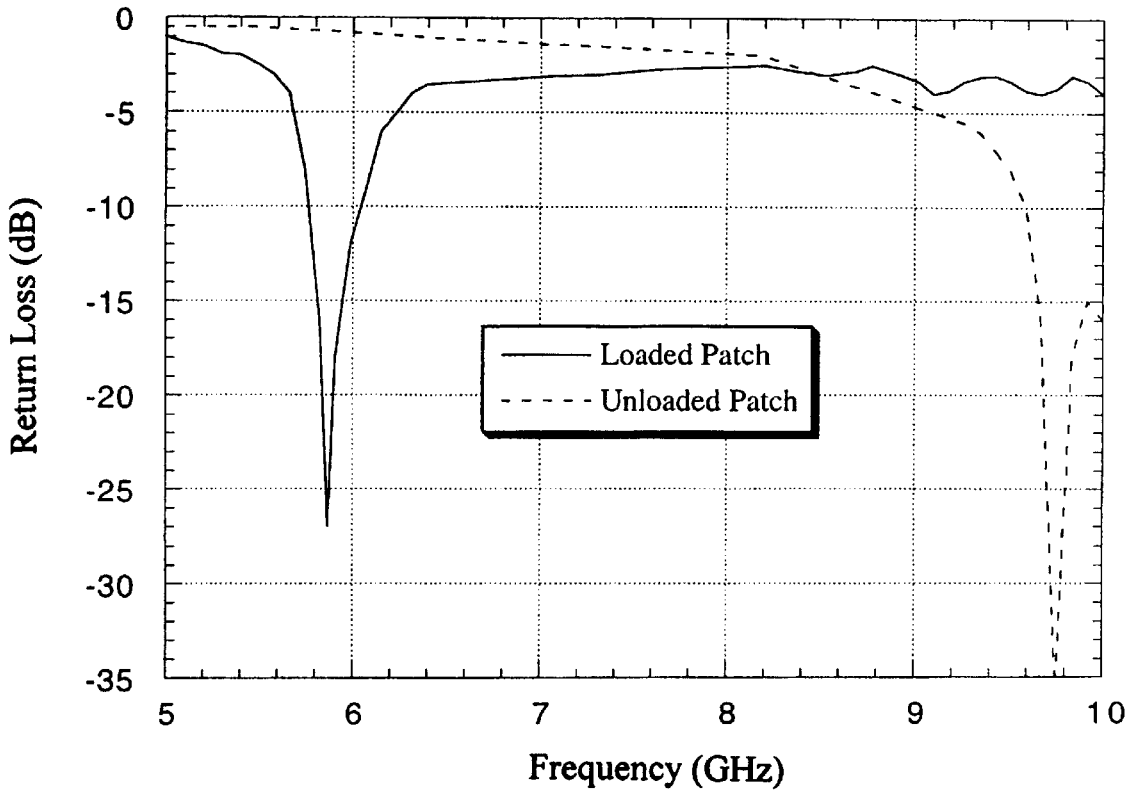
FIG. 4 illustrates in a graph, a reduction of resonant frequency by dielectric loading obtained with a first embodiment of the present invention.

Preferred embodiments are described to illustrate the performance of dielectric loaded microstrip patches. In a first embodiment, dielectric loading is used to reduce a resonant frequency. A slot-fed square patch 109 having an unloaded operating frequency of 9.69 GHz, is loaded with a dielectric strip 115 (with a dielectric constant $\in_{r2}$=20) causing the resonant frequency of the loaded patch 109 to drop to 5.86 GHz, a reduction to 60% of the original frequency. These results are seen in the measured return loss plots of FIG. 4.

Figure 5:
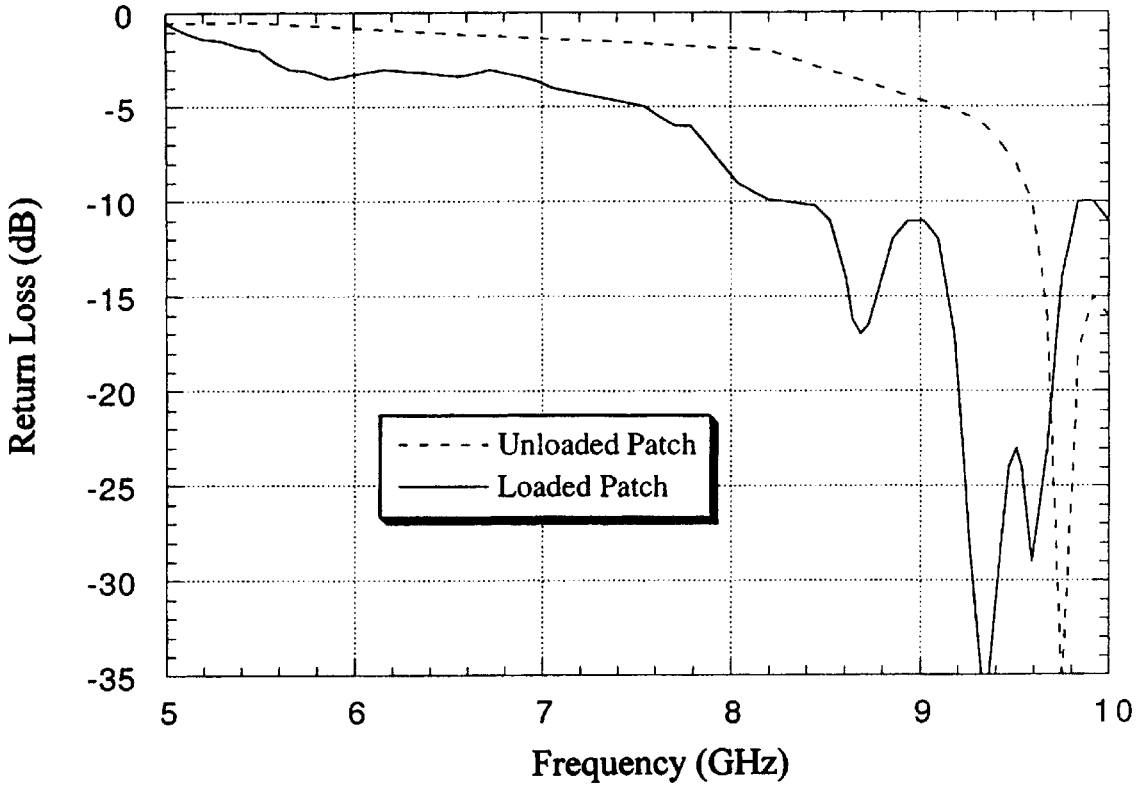
FIG. 5 illustrates in a graph, an increase in bandwidth by dielectric loading obtained with a second embodiment of the invention.

In a second embodiment, dielectric loading is used for increasing the bandwidth of the patch. Here, the unloaded square patch 109 has a 10 dB return loss bandwidth of approximately 4%. When loaded with a dielectric strip 115 with a dielectric constant $\in_r$=40, the bandwidth increases to approximately 21%. These results are seen in the measured return loss plots of FIG. 5.

Figure 6A:
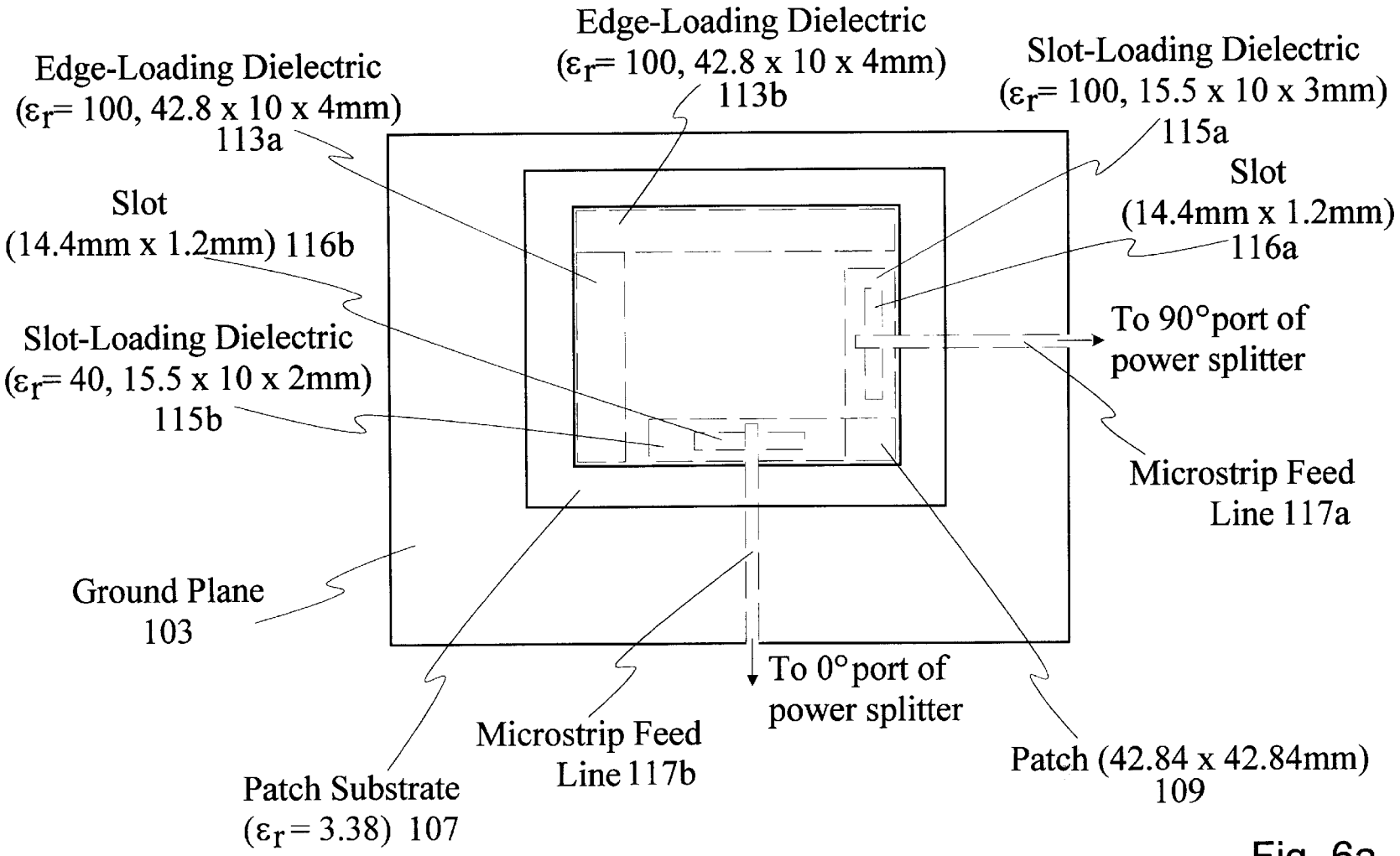
FIG. 6*a* illustrates in a top view and FIG. 6*b* illustrates in a front cross-sectional view a dielectric loaded microstrip patch configuration in accordance with an embodiment of the present invention.
Figure 6B:
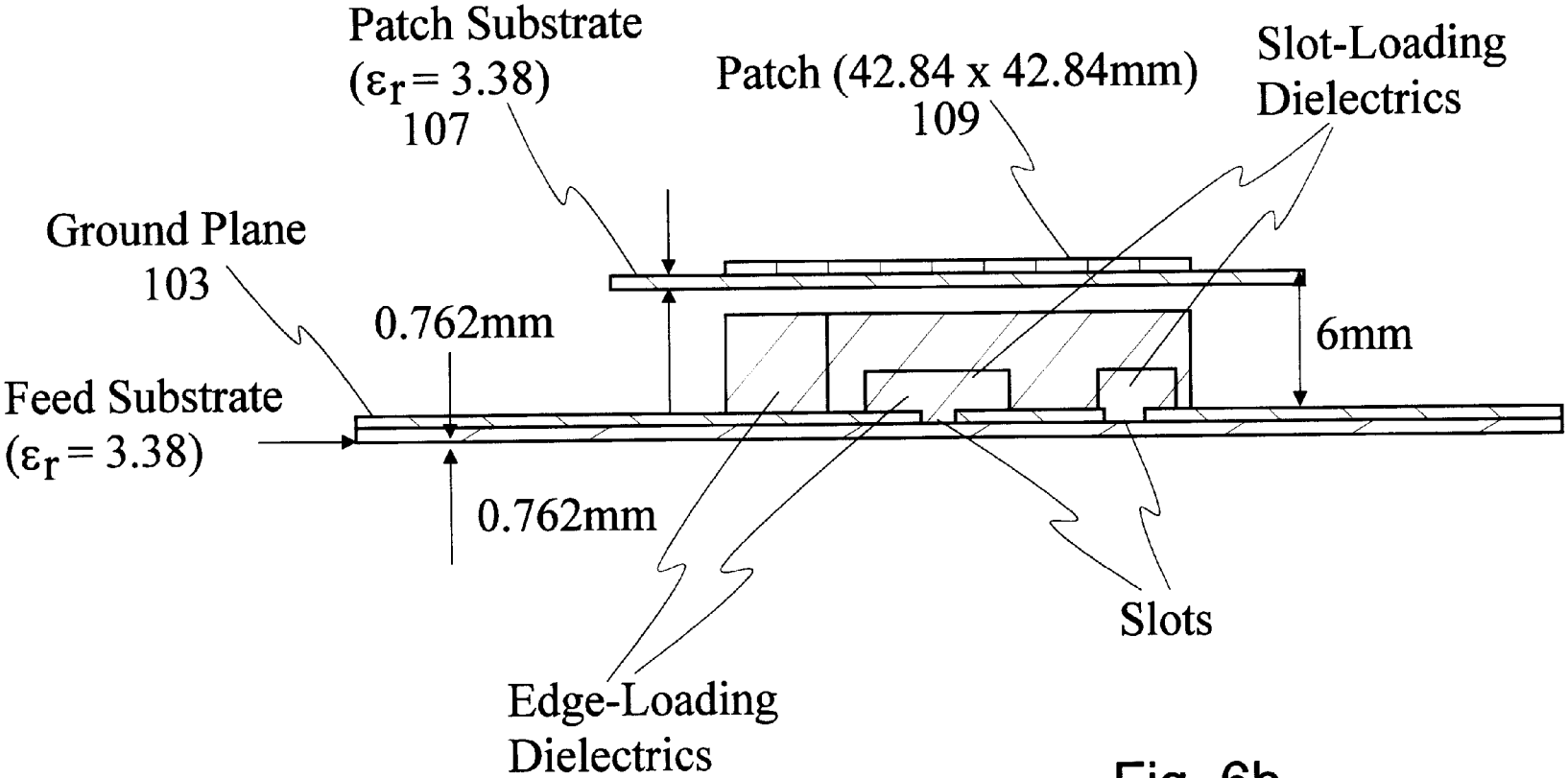

Referring to FIGS. 6*a* and 6*b*, an embodiment of the invention is shown wherein the antenna is for radiating circularly polarised radiation. Loading of the slot 116*a* is achieved using dielectric means in the form of dielectric strip 115*a* and loading of the slot 116*b* is achieved using dielectric means in the form of dielectric strip 115*b*, which are strategically placed adjacent the respective slots 116*a* and 116*b* between the microstrip patch radiator 103 and the ground plane 103. The antenna geometry shown comprises a conducting microstrip patch 109 on a very thin substrate spaced above a ground plane 103 by an air dielectric. As shown in the cross sectional view, the thin dielectric layer 107 and patch 109 thereon are 6 mm away from the ground plane 103. It will be evident to those of skill in the art that spacing of this magnitude with an air dielectric results in poor coupling efficiency between the feed slots 116*a* and 116*b* and the patch 109. That said, increased spacing also results in higher bandwidth, which is often desirable.

A first peripheral dielectric strip 115*a* acts to modify the radiation field from the feed 116*a* and a second peripheral dielectric strip 115*b* acts to modify the radiation field from the feed 116*b*. The first and second peripheral dielectric strips 115*a* and 115*b* have a dielectric constant $\in_{r1}$. Optionally each of the peripheral dielectric strips 115*a* and 115*b* has a different dielectric constant. The other dielectric strips 113*a* and 113*b* have a dielectric constant $\in_{r2}$. Optionally each of the dielectric strips 113*a* and 113*b* has a different dielectric constant. The other dielectric strips 113*a* and 113*b* act to reduce the overall size of the patch 109 for radiating at a predetermined frequency. The other dielectric strips 113*a* and 113*b* also act to reduce the overall bandwidth. Therefore, there is a design trade-off between operational bandwidth and size of the antenna. The feed slots 116*a* and 116*b* are coupled to microstrip feed lines 117*a* and 117*b*, respectively, for providing energy to the feed slots 116*a* and 116*b*.

The operating frequency of the antenna is determined by the dielectric permittivity, dimensions, and location of the peripheral dielectric strips 113*a* and 113*b*. The maximum effect will occur at the location where the electric field is maximum. The slot loading dielectric strips 115*a* and 115*b* are used to perform the function of matching the impedance of the antenna to that of the feed network. In FIGS. 6*a* and 6*b*, the feed network is again represented by feed slots 116*a* and 116*b* in the ground plane 103, however, the invention is equally applicable for other forms of feeding means to provide radio signal energy to the patch radiator 109. Examples of other feeds include a probe and proximity coupled microstrip lines (not shown).

Of course, where bandwidth is the only major concern, the dielectric strips 113*a* and 113*b* are omitted providing for a larger patch 109 and a larger bandwidth than when the dielectric strips 113*a* and 113*b* are present.

Theoretically, it is believed that the piece of dielectric material 115 loads the slot and thereby improves overall coupling of the feed 106 to the patch 109. The dielectric material 115 is almost invisible to the patch 109 since it is loading the slot 106. Two slots are shown in FIGS. 6*a* and 6*b* to achieve circular polarisation. Of course, a single slot could also be used if it were designed to excite circularly polarised radiation in the patch. One such embodiment involves a slot feed angled at approximately 45 degrees to each patch edge and positioned near a corner of the patch 109 (when viewed from above) to excite the patch 109 along each of its orthogonal axes. Generation of other forms of polarised radiation are also possible such as dual polarised radiation.

Figure 3A:
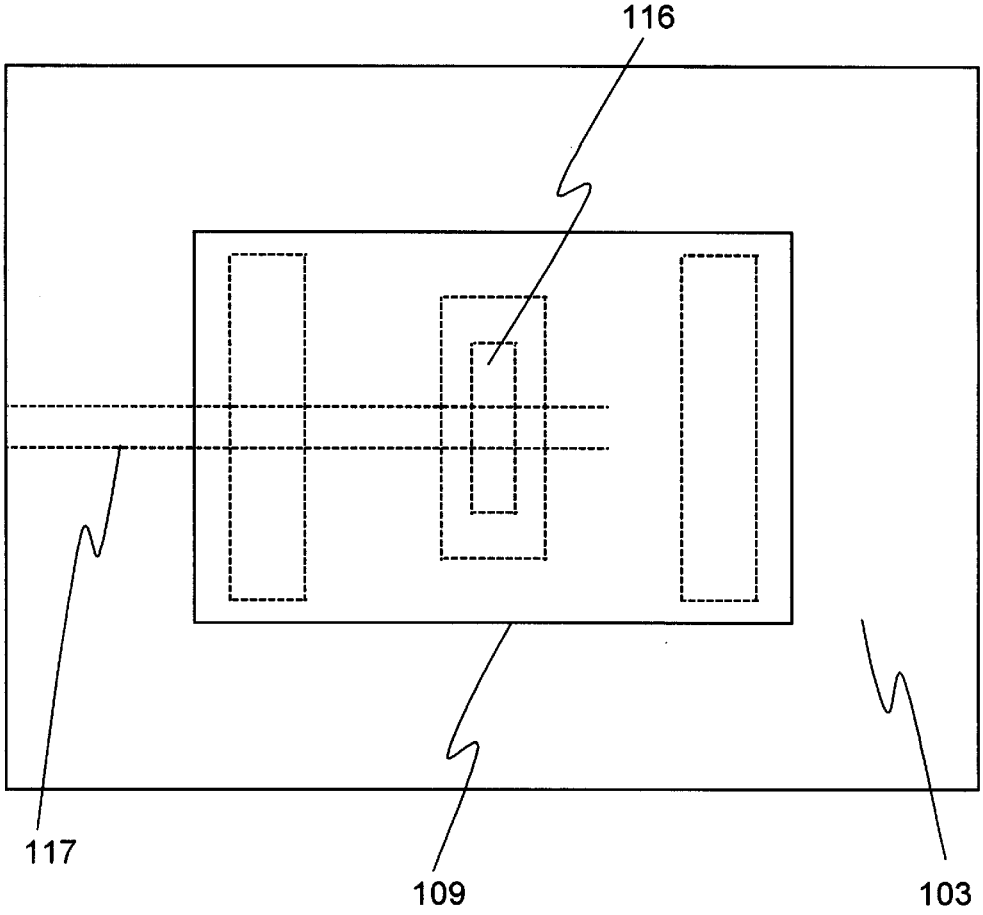
FIGS. 3*a* and 3*b* illustrate in a top view a dielectric loaded microstrip patch configuration in accordance with an embodiment of the present invention.
Figure 3B:
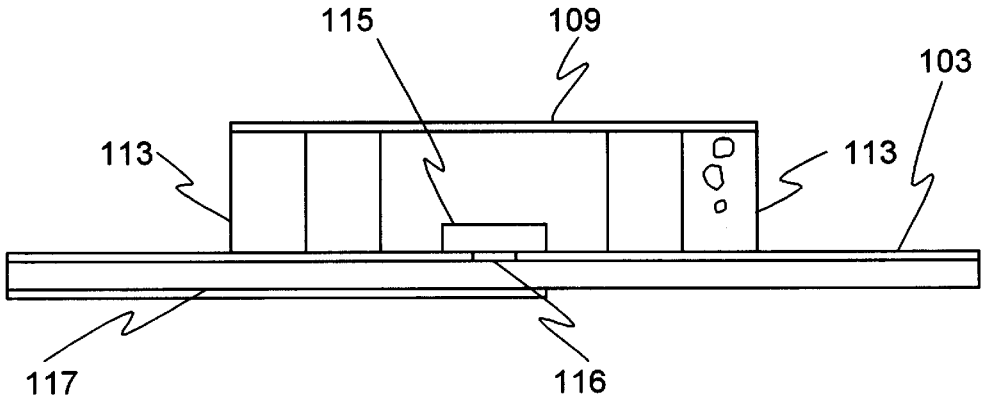
Figure 3C:
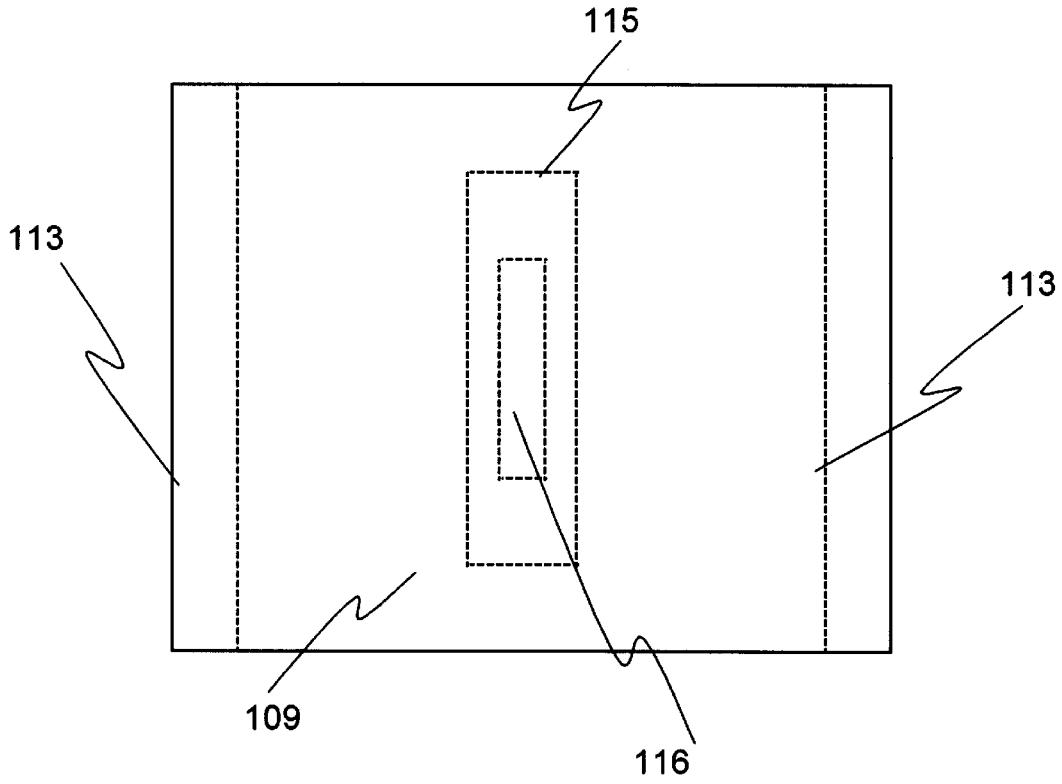
FIGS. 3*c* and 3*d* illustrate in a front cross-sectional view a dielectric loaded microstrip patch configuration in accordance with an embodiment of the present invention.
Figure 3D:
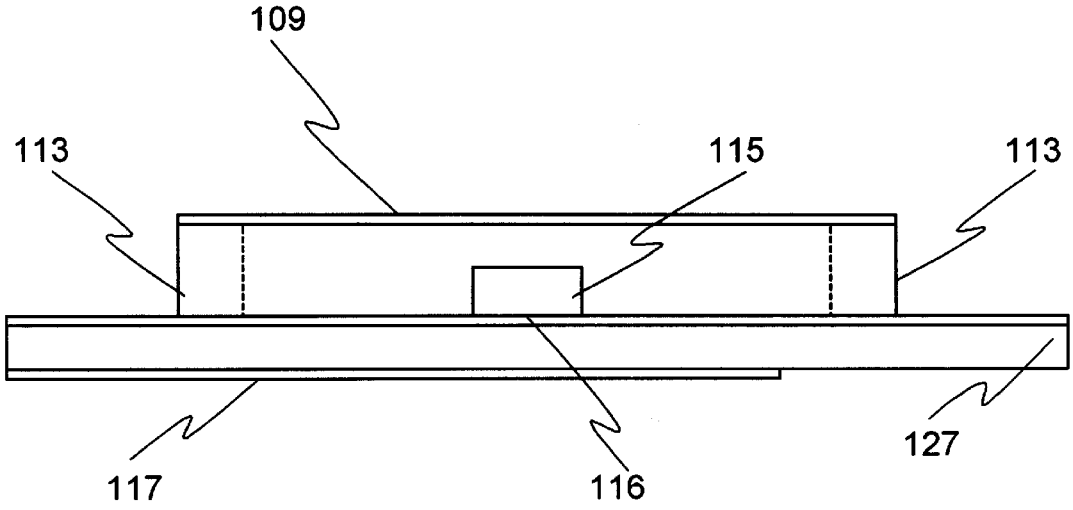

Conversely, the pieces of dielectric material 113 load the patch and act to reduce the resonant frequency of the patch 109. This results in a smaller patch size for radiating at a same frequency. Placement of the pieces of dielectric material 113 is shown at the outer edges of the patch 109 (when viewed from above) in order to provide maximum E field loads. The pieces of dielectric material 113 could also be located outside the patch boundaries (when viewed from above) if design requirements are still met. Preferably the pieces of dielectric material 113 are tall and thin blocks or strips of dielectric material. Fatter blocks reduce bandwidth further and are therefore undesirable. Of course, optionally two pieces of dielectric material 113 are located at opposing ends of a same axis of the patch 109 as shown in FIGS. 3*a* and 3*b*. Similarly, optionally, four pieces of dielectric material 113 are located, one along each edge of the patch 109.

Figure 7:
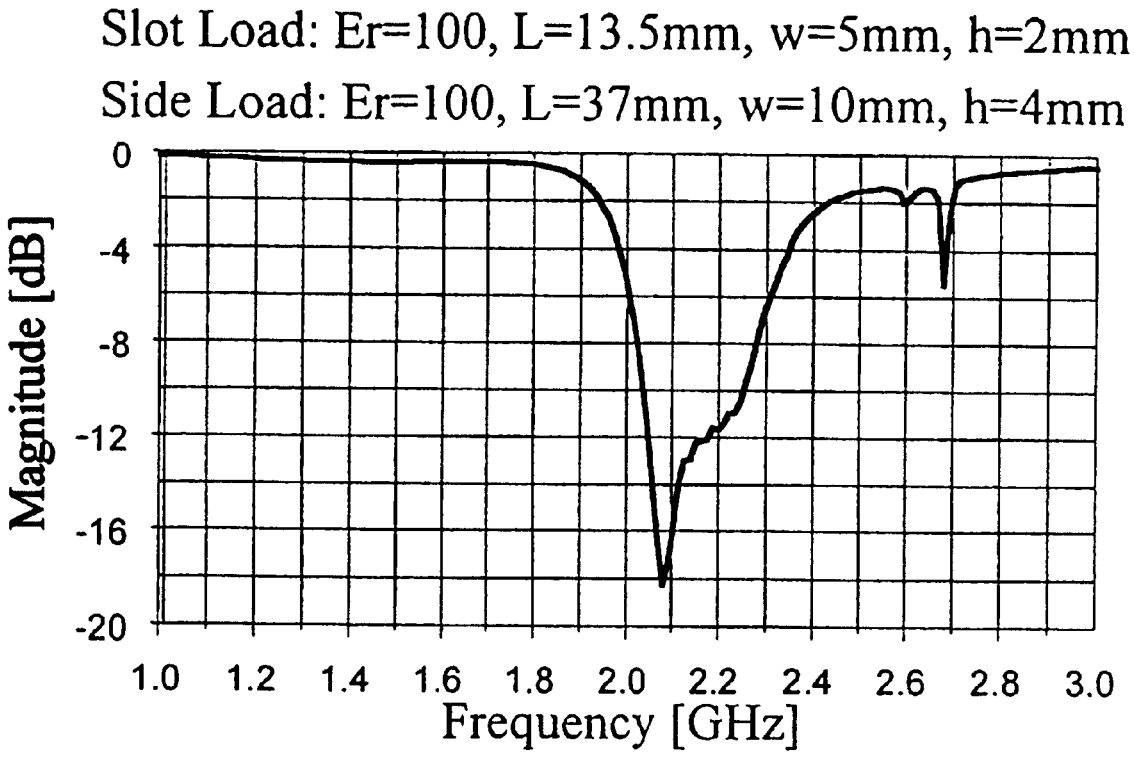
FIG. 7 illustrates two graphs for measured return loss and impedance locus of a linear-polarised dielectric loaded patch.
Figure 7:
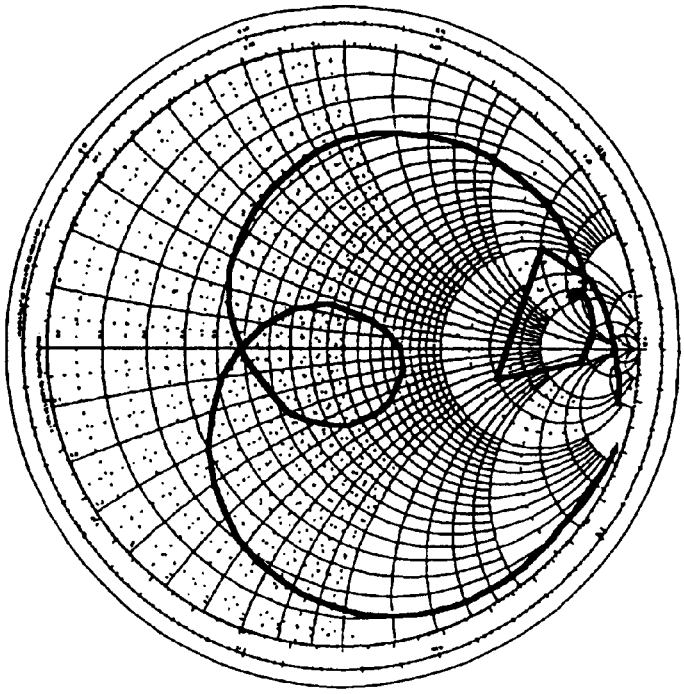

Referring to FIG. 7, two graphs are presented for measured return loss and impedance locus of a linear-polarised dielectric loaded patch according to the invention.

Figure 8A:
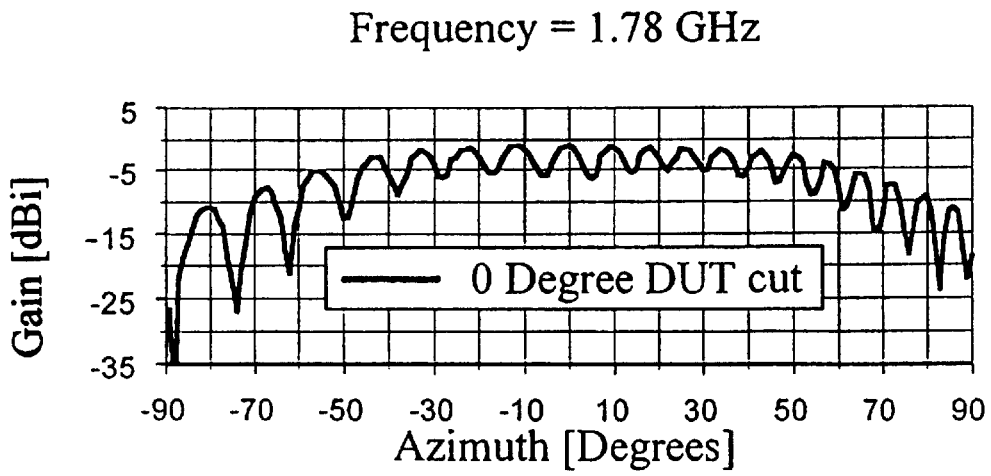
FIGS. 8*a*, 8*b* and 8*c* illustrate graphically a measured radiation patterns of a circularly polarised dielectric loaded patch; and, FIG. 9 illustrates graphically measured radiation patterns of a linear-polarised dielectric loaded patch.
Figure 8B:
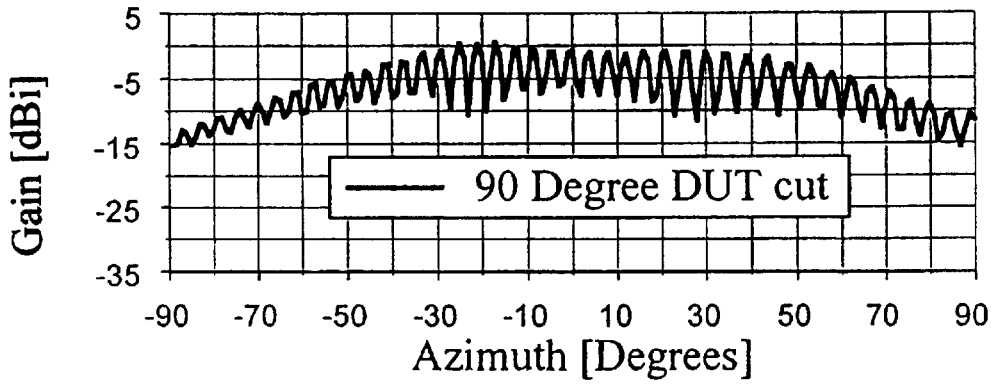
Figure 8C:
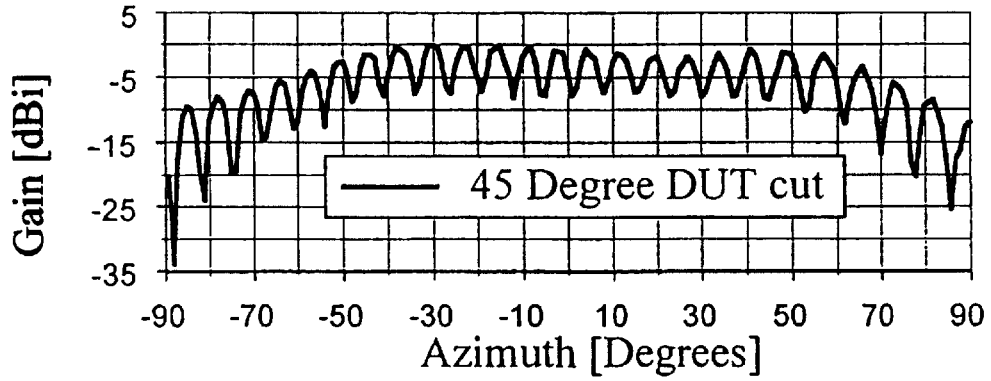

Referring to FIGS. 8*a*, 8*b* and 8*c*, graphs are presented for measured radiation patterns of a circularly polarised dielectric loaded patch according to the invention.

Figure 9:
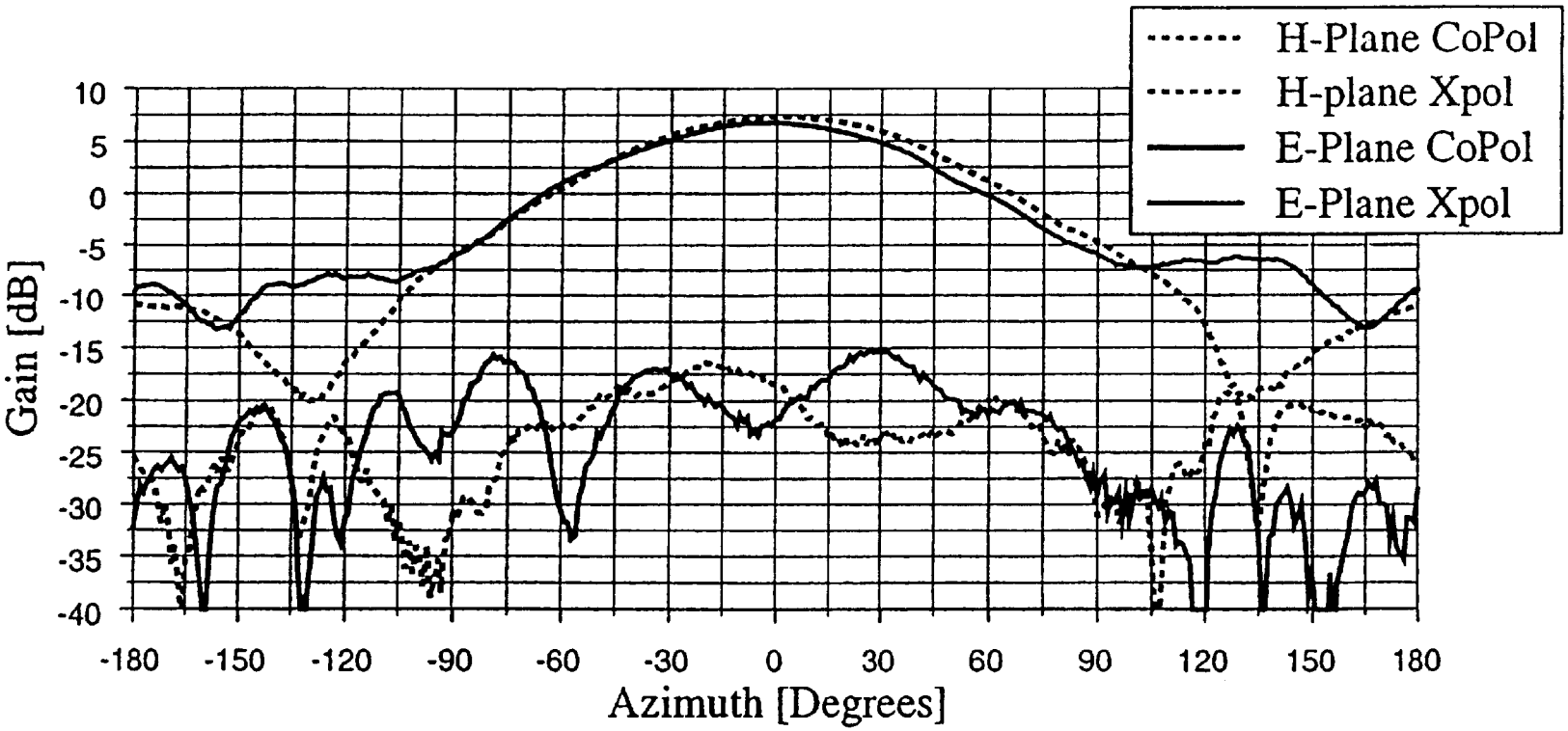

Referring to FIG. 9, a graph is presented for measured radiation patterns of a linear-polarised dielectric loaded patch according to the invention.

A final design to determine the number of dielectric strips, their location, their dimensions, and dielectric permittivity depends on the intended operation of the antenna for the specific application.

Though according to the embodiment of FIG. 2, the radiator layer 106 is supported by a ground plane 103 made of electrically conductive material having a plurality of integral support posts or dimples 105 extending substantially perpendicularly from one face of the ground plane 103, this need not be so. In an alternative embodiment, the support posts 105 are integral with the radiator layer 106 and extend substantially perpendicularly from one face thereof to contact the ground plane 103. In yet another alternative embodiment, a portion of the support posts 105 are integral with the ground plane 103, while the remainder are integral with the radiator layer 106. In yet another embodiment, the support posts 105 are formed such that one or more of the posts are comprised of a first portion that is integral with the ground plane 103 and a mating second portion is integral with the radiator layer 106. In any case, the support posts 105 support the radiator layer 106 to maintain a substantially uniform air gap 110 of a predetermined thickness between the radiator patch 109 and the ground plane 103. In yet another embodiment, standard spacers in the form of posts not integral to either the ground plane or the patch substrate are used to position the patch relative to the ground plane. Optionally a further single support post with, for example, an annular shape, is utilised.

Even though in each embodiment of the invention described and illustrated the piece of dielectric material is a block or strip, this need not be so. The use of a block or strip is often simpler to model and therefore renders the design process less complicated. That said, it is also possible to use dielectric pieces of arbitrary shape or discontinuous pieces of dielectric material or pieces of dielectric material having other than constant dielectric values.

Also, though in each embodiment of the invention described and illustrated the piece of dielectric material for loading the slot feed is positioned directly on the feed slot, this need not be so. The dielectric material for loading the feed slot is positioned according to desired design parameters including loading properties and desired Q factor or Q factor changes.

The advantages to an air spaced patch are numerous. That said, many very low dielectric constant materials are known such as foams which are also useful in accordance with the invention. When a foam is used for filling the space between the patch and the ground plane, support posts are obviated. In a simple embodiment, the pieces of dielectric material are positioned on the ground plane according to design parameters and then the foam is injected to fill a space above the ground plane where the pieces of dielectric material are not present. The patch is either placed on top of the foam or, during injection, forms an upper layer to bound the foam dielectric material.

Numerous other embodiments can be envisaged without departing from the spirit or scope of the invention.

What is claimed is:

1. A microstrip patch antenna comprising:

a patch radiator;

a conducting ground plane spaced from the patch radiator by a first predetermined distance along a z-axis;

a first dielectric material having a low dielectric constant and disposed between the ground plane and the patch radiator;

a feed for providing the patch radiator with radio signal energy; and, a piece of a second dielectric material having a higher dielectric constant than the first dielectric material for loading the feed and having a dimension along an axis orthogonal to the z-axis smaller than a dimension along a same axis of the patch and disposed along a line parallel to the z-axis between said patch radiator and said ground plane for determining operational characteristics of said microstrip patch antenna.

2. An antenna as defined in claim 1 wherein the ground plane is approximately parallel to and spaced from the patch radiator.

3. An antenna as defined in claim 2 wherein the patch radiator is a microstrip patch.

4. An antenna as defined in claim 3 wherein the feed is a slot in the ground plane.

5. An antenna as defined in claim 4 wherein the second dielectric for loading the feed is a rectangular dielectric block having a height less than the predetermined distance and having a distance along a line perpendicular to a line along the direction of the predetermined distance that is smaller than a distance along a parallel line on the microstrip patch.

6. An antenna as defined in claim 1 comprising two pieces of third dielectric material for shifting the resonant frequency of the patch radiator.

7. An antenna as defined in claim 6 wherein the two pieces of third dielectric material for shifting the resonant frequency of the patch radiator are two rectangular blocks of the third dielectric material.

8. An antenna as defined in claim 7 wherein the third dielectric material is a same dielectric material as the second dielectric material.

9. An antenna as defined in claim 1 wherein the feed is a feed for exciting the patch radiator to radiate circularly polarised radiation.

10. An antenna as defined in claim 9 wherein the feed comprises a first slot in the ground plane for exciting the patch along a first axis thereof and a second slot in the ground plane for exciting the patch radiator along a second axis thereof orthogonal to the first axis.

11. An antenna as defined in claim 10 wherein the second dielectric for loading the feed comprises a first piece of dielectric material for loading the first slot and a second piece of dielectric material for loading the second slot.

12. An antenna as defined in claim 11 wherein the first and second pieces of dielectric material are each a rectangular block of dielectric material having a height less than the predetermined distance and having a distance along any line perpendicular to a line along the direction of the predetermined distance that is smaller than a distance along a parallel line on the microstrip patch.

13. An antenna as defined in claim 9 comprising a first piece of a third dielectric material for shifting the resonant frequency of the patch radiator along the first axis and a second piece of a third dielectric material for shifting the resonant frequency of the patch radiator along the second axis.

14. An antenna as defined in claim 13 wherein the two pieces of third dielectric material for shifting the resonant frequency of the patch radiator are two rectangular blocks of the third dielectric material having a dielectric constant higher than the dielectric constant of the first dielectric material.

15. A method of designing a microstrip patch antenna comprising the steps of:

providing a design of a patch radiator;

providing a design of a conducting ground plane spaced from the patch radiator by a first predetermined distance along a z-axis;

providing a design for a feed for providing the patch radiator with radio signal energy; and, providing a design for a second dielectric for loading the feed and having a dimension along an axis orthogonal to the z-axis smaller than a dimension along a same axis of the patch and disposed between said patch radiator and said ground plane for determining operational characteristics of said microstrip patch antenna simulating the provided designs; and, adjusting the design of the second dielectric until a desired radiation pattern from the microstrip patch results.

16. A microstrip patch antenna comprising:

a conducting ground plane having a thickness along a z axis and dimensions along an x and y axis orthogonal to the z axis;

a patch radiator spaced by a first dielectric material having a low dielectric constant from the ground plane along the z-axis orthogonal;

a slot feed for providing the patch radiator with radio signal energy across the space containing the first dielectric material; and, a piece of second dielectric material adjacent the slot feed between the patch radiator and the ground plane for loading the feed and having a dimension along one of the x and y axes smaller than a dimension of the patch along a same axis, wherein the piece of second dielectric material determines operational characteristics of the microstrip patch antenna, the second dielectric material having a dielectric constant that is higher than the dielectric constant of the first dielectric material.

* * * * *